United States Patent [19]

MacIntyre et al.

[11] Patent Number: 4,957,855

[45] Date of Patent: Sep. 18, 1990

[54] PHOTOGRAPHIC RECORDING MATERIAL WITH IMPROVED RAW STOCK KEEPING

[75] Inventors: Gladys L. MacIntyre, Clyde; Roger Lok, Hilton, both of N.Y.

[73] Assignee: Eastman Kodak Company, Rochester, N.Y.

[21] Appl. No.: 410,693

[22] Filed: Sep. 21, 1989

[51] Int. Cl.[5] ..... G03C 1/34

[52] U.S. Cl. ..... 430/611; 430/551; 430/554

[58] Field of Search ..... 430/551, 611, 554

[56] References Cited

U.S. PATENT DOCUMENTS

| | | | |
|---|---|---|---|
| 3,397,987 | 8/1968 | Luckey et al. | 96/109 |
| 3,519,429 | 7/1970 | Lestina et al. | 96/100 |
| 3,708,303 | 1/1973 | Salesin | 96/107 |
| 3,930,866 | 1/1976 | Oishi et al. | 96/100 |
| 3,945,829 | 2/1976 | Zorn et al. | 96/74 |
| 4,346,165 | 8/1982 | Sawada et al. | 430/372 |
| 4,634,660 | 1/1987 | Mifune et al. | 430/375 |

FOREIGN PATENT DOCUMENTS

| | | |
|---|---|---|
| 0255785 | 2/1988 | European Pat. Off. . |
| 0295507 | 12/1988 | European Pat. Off. . |
| 3332688 | 9/1983 | Fed. Rep. of Germany . |
| 63-037343 | 2/1988 | Japan . |

*Primary Examiner*—Paul R. Michl
*Assistant Examiner*—Janis L. Dote
*Attorney, Agent, or Firm*—Paul A. Leipold

[57] ABSTRACT

The raw stock keeping quality of photographic recording material is improved without loss of photographic speed. The improved keeping quality results from a combination of agents which cause speed losses when separately employed.

6 Claims, No Drawings

PHOTOGRAPHIC RECORDING MATERIAL WITH IMPROVED RAW STOCK KEEPING

The present invention relates to photographic recording materials. In particular, this invention relates to improvements in the stability of photographic recording materials prior to exposure.

Silver halide photosensitive layers are subject to fogging conditions during storage prior to use. Attempts have been made to reduce the amount of fogging by adding inhibitory agents to the silver halide layers. For example, U.S. Pat. No. 3,397,987 describes the addition of mercaptotetrazoles to silver halide emulsions to lessen the tendency toward fog formation during storage.

U.S. Pat. No. 3,708,303 teaches adding different amidophenylmercaptotetrazole compounds to high contrast photographic recording materials comprising at least 50% of silver chloride in the emulsion layer to lower fog formation prior to exposure.

U.S. Pat. No. 3,945,829 discloses the use of heterocyclic mercapto compounds in a colloidal silver-containing layer for the purpose of reducing fog.

German Patent Application No. 3,332,688A discloses use of 3- or 4- acylamidophenylmercapto tetrazoles as fog retardants under high-humidity keeping conditions.

Although these various agents have been found to impart improvements of different types, individually they do not succeed in overcoming the full range of problems associated with keeping qualities prior to exposure, such as fog inhibition or changes in photographic speed.

Accordingly, the object of the present invention is to provide a combination of antifogging agents which successfully reduce unwanted fog during storage while maintaining desirable photographic speed.

The present invention relates to a photographic recording material comprising a support, a silver halide emulsion layer and from about 1.5 mmoles to about 5.0 mmoles per mole of silver of an antifogging agent which is a combination of two compounds comprising, for each mole of 1-(3-acetamidophenyl)-5-mercaptotetrazole from 0.3 to 4.0 moles, of 1-(3-methoxyphenyl)-5-mercaptotetrazole.

The compound 1-(3-methoxyphenyl)-5-mercaptotetrazole (hereinafter MPMT), when used alone as an antifogging agent, causes severe white light speed loss. On the other hand, the compound 1-(3-acetamidophenyl)-5-mercaptotetrazole (hereinafter APMT) is effective in reducing fog levels, but causes an increase in intrinsic speed, adversely affects reciprocity characteristics of an emulsion and can cause the red sensitizing dye to be displaced from the silver halide grains. When the level of APMT is increased in order to improve keeping quality, white light speed loss occurs.

The combination of MPMT and APMT as an antifogging agent permits use of lesser amounts of APMT. The combination can be used effectively in two ways. For example, the combination can be added to a silver halide emulsion melt prior to coating. The melt can be a silver halide gelatin melt as shown below in Example 1. When the combination is employed in this manner the amount of the total antifoggant concentration can be from 1.5 to 2.5 mmoles per mole of silver so long as the two antifoggant components are present in a ratio of 0.3 to 4.0 mmole of MPMT per mmole of APMT.

The second way in which the antifoggant concentration can be used is to add one of the components to a coupler dispersion and the other component to a silver halide emulsion melt as shown below in Example 2. This latter method of use generally requires a somewhat higher total concentration of antifoggant of from about 2.5 to about 5 mmoles per mole of silver.

When the coupler compound is added to a silver halide emulsion, conventional procedures may be employed. For example, the coupler can first be dissolved in one or more known coupler solvents, such as di-n-butylphthalate (DBP), and then be mixed with the silver halide emulsion. If desired, the coupler compound can be mixed with one or both of the antifogging compounds. The resulting mixture or solution is then dispersed in aqueous gelatin, preferably containing a surfactant, and the dispersion can then be added to a silver halide emulsion melt. Subsequently, the resulting melt can be coated by known techniques.

Although very useful results are obtained when the antifoggant combination is employed with photographic recording materials containing magenta dye-forming couplers, other coupler compounds can also be employed.

Couplers which form magenta dyes upon reaction with oxidized color developing agents are described in such representative patents and publications as: U.S. Pat. Nos. 1,969,479; 2,311,082; 2,343,703; 2,369,489; 2,600,788; 2,908,573; 3,061,432; 3,062,653; 3,152,896; 3,519,429; 3,725,067; 4,120,723; 4,500,630; 4,540,654 and 4,581,326; and European Patent Publication Nos. 170,164 and 177,765; and copending U.S. application Ser. Nos. 23,517 of S. Normandin et al.; 23,518 of R. Romanet et al.; 23,519 of A. Bowne et al. and 23,520 of A. Bowne et al., all filed Mar. 9, 1987, the disclosures of which are incorporated herein by reference.

Couplers which form cyan dyes upon reaction with oxidized color developing agents are described in such representative patents and publications as U.S. Pat. Nos. 2,474,293; 2,772,162, 2,801,171; 2,895,826; 3,002,836; 3,419,390; 3,476,563; 3,779,763; 3,996,253; 4,124,396; 4,248,962; 4,254,212; 4,296,200; 4,333,999; 4,443,536; 4,457,559; 4,500,635 and 4,526,864, the disclosures of which are incorporated herein by reference.

Couplers which form yellow dyes upon reaction with oxidized color developing agent are described in such representative U.S. Pat. Nos. 2,298,443; 2,875,057; 2,407,210; 3,265,506; 3,384,657; 3,408,194; 3,415,652; 3,447,928; 3,542,840; 4,046,575; 3,894,875; 4,095,983; 4,182,630; 4,203,768; 4,221,860; 4,326,024; 4,401,752; 4,443,536; 4,529,691; 4,587,205; 4,587,207 and 4,617,256 the disclosures of which are incorporated herein by reference.

Photographic recording materials of this invention in which one or more photographic couplers are incorporated can be simple recording materials comprising a support and a single silver halide emulsion layer, or they can be multilayer, multicolor elements. A typical multilayer, multicolor photographic recording material comprises a support having thereon a red-sensitive silver halide emulsion layer having associated therewith a cyan dye image-forming coupler compound, a green-sensitive silver halide emulsion layer having associated therewith a magenta dye image-forming coupler compound and a blue-sensitive silver halide emulsion layer having associated therewith a yellow dye image-forming coupler compound. Each silver halide emulsion layer can be composed of one or more layers and the layers can be arranged in different locations with respect to one another. Typical arrangements are described in U.S. Pat. Nos. 3,227,554; 3,620,747; 3,843,369; and 4,400,463 and in U.K. Patent No. 923,045.

In the following discussion of suitable materials for use in the elements of this invention, reference will be made to *Research Disclosure* Dec. 1978, Item 17643, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "*Research Disclosure.*"

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Color developers generally comprise alkaline aqueous solutions containing color developing agents. As color developing agents, known primary aromatic amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-methanesulfoamidoethylaniline, and 4-amino-3-methyl-N-ethyl-N-β-methoxyethylaniline) can be used.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-ethylaniline hydrochloride and 4-amino-N-ethyl-N-(2-methoxyethyl)-m-toluidine do-p-toluenesulfonic acid.

Development is followed by the conventional steps of bleaching, fixing, or bleach-fixing, to remove silver or silver halide, washing, and drying.

Photographic emulsions as used herein can be prepared by the methods described in Research Disclosure Sections I and II and the publications cited therein. Any of an acidic, neutral, or ammonia process, etc. can be employed, and soluble silver salts and soluble halogen salts may be reacted in any suitable manner.

The silver halide emulsions employed in the recording materials of this invention can be comprised of silver bromide, silver chloride, silver iodide, silver chlorobromide, silver chloroiodide, silver bromoiodide, silver chlorobromoiodide or mixtures thereof. However, the invention has been found to be especially effective when the silver halide is predominantly silver chloride. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,424,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,414,966 and Daubendiek et al. U.S. Pat. Nos. 4,672,027 and 4,693,964. Also specifically contemplated are those silver bromoiodide grains with a higher molar proportion of iodide in the core of the grain than in the periphery of the grain, such as those described in GB No. 1,027,146; JA 54/48,521; U.S. Pat. Nos. 4,379,837; 4,444,877; 4,665,012; 4,686,178; 4,565,778; 4,728,602; 4,668,614 and 4,636,461; and in EP No. 264,954. The silver halide emulsions can be either monodisperse or polydisperse as precipitated.

The grain size distribution of the emulsions can be controlled by silver halide grain separation techniques or by blending silver halide emulsions of differing grain sizes.

Sensitizing compounds, such as compounds of copper, thallium, lead, bismuth, cadmium, iridium and other Group VIII noble metals, can be present during precipitation of the silver halide emulsion.

The emulsions can be surface-sensitive emulsions, i.e., emulsions that form latent images primarily on the surfaces of the silver halide grains. The silver halide emulsions can be surface sensitized using noble metals (e.g., gold), middle chalcogens (e.g., sulfur, selenium, or tellurium), or reduction sensitizers, employed either individually or in combination. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Reseach Disclosure*, Item 17643, cited above, Section IV.

Suitable vehicles for the emulsion layers and other layers of elements of this invention are described in Research Disclosure Item 17643, Section IX and the publications cited therein.

The photographic recording materials of this invention can contain brighteners (Research Disclosure Section V), stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure X), coating aids (Research Disclosure Section XI), plasticizers and lubricants (Research Disclosure Section XII), antistatic agents (Research Disclosure Section XIII), matting agents (Research Disclosure Sections XII and XVI) and development modifiers (Research disclosure Section XXI).

The photographic recording materials can be coated on a variety of supports as described in Research Disclosure Section XVII and the references described therein. Incorporation of couplers into silver halide emulsion layers can be achieved by known techniques, e.g., the method described in U.S. Pat. No. 2,322,027.

The following examples are intended as further illustrations of this invention.

EXAMPLE 1

Photographic materials were prepared wherein APMT and MPMT were each used alone and in combination in silver chloride emulsions (290 mg/m$^2$ of Ag), (0.31 μm cubic edge length, AuS sensitized) in amounts as noted below in Table I.

The emulsion layers were coated with a magenta dye forming coupler dispersed in a coupler:solvent ratio of 2:1. The coupler had the formula noted below*. The coupler solvent was di-n-butylphthalate. Exposure was for 1/10 sec. to a 3000° K. light source attenuated to a Wratten 12 filter through a graduated density step-wedge and processed at 35° C. as follows:

*Magenta Coupler

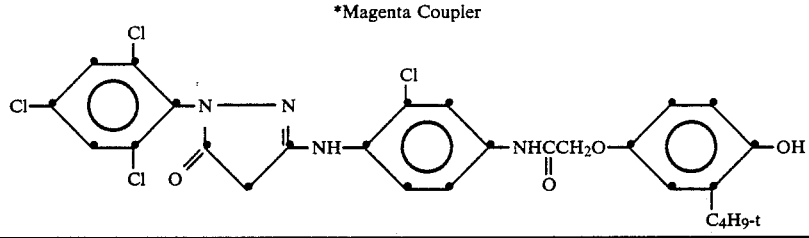

| | | |
|---|---|---|
| color development | 45 | sec. |
| bleach-fix (FeEDTA) | 45 | sec. |
| wash | 3 | min. |
| developer composition: | | |
| 4-amino-3-methyl-N-ethyl-betahydroxyethylanaline sulfite | 5.0 | g/l |
| Triethanolamine (99%) | 11.0 | mls |
| $LiSO_4$ | 2.7 | g/l |
| $K_2CO_3$ | 25.0 | g/l |
| KBr | 0.025 | g/l |
| KI | 1.8 | g/l |
| Water to 1 liter | | |
| pH adjusted to 10.12 | | |

Speed and fog data were obtained from the densitometry results which are reported in Table I.

TABLE I

| Compound | | mmoles/ mole Ag | | Fresh | | | | Incubated 2 wks./49° C./50% RH | |
|---|---|---|---|---|---|---|---|---|---|
| APMT | MPMT | APMT | MPMT | Dmin | Speed | Shoulder | Toe | ΔDmin | ΔSpeed |
| + | — | 1.62 | — | 0.106 | 189 | 1.92 | 0.35 | +0.058 | +15 |
| + | — | 1.02 | — | 0.113 | 195 | 2.09 | 0.34 | +0.078 | +17 |
| — | + | — | 0.61 | — | — | no speed | — | — | — |
| APMT | MPMT | 1.02 | 0.61 | 0.115 | 190 | 2.05 | 0.33 | +0.021 | +11 |

As is evident from Table I the combination of both APMT and MPMT, within the range found to be useful with this invention, yielded reduced Dmin on incubation.

EXAMPLE 2

The following Table 2 shows the effects of adding MPMT to a coupler dispersion and APMT to a silver halide gelatin emulsion melt, similar to that employed in Example 1. Both the coupler dispersion and the silver halide emulsion were then combined, melted and coated. The concentration of both antifoggant components is shown in the Table. For comparison, 1-phenyl-5-mercaptotetrazole (PMT) was used to replace the MPMT. Exposure and processing was as described in Example I.

TABLE 2

| mmoles Compound/ mole/Ag in gelatin dispersion | Coupler Dispersion mg/m² | Dmin | Speed | Fresh Sensitometry Shoulder | Toe | Incubated 6 days/60° C. ΔDmin | ΔSpeed |
|---|---|---|---|---|---|---|---|
| 1.62 APMT | 0 | 0.105 | 195 | 1.93 | 0.35 | +.203 | +22.5 |
| 1.62 APMT | 1.076 PMT | 0.101 | 191 | 1.94 | 0.34 | +.143 | +18.0 |
| 1.62 APMT | 2.152 PMT | 0.099 | 190 | 1.97 | 0.32 | +.124 | +17.2 |
| 1.62 APMT | 2.152 MPMT | 0.100 | 190 | 1.96 | 0.32 | +.085 | +14.4 |
| 1.05 APMT | 2.152 MPMT | 0.099 | 194 | 2.08 | 0.31 | +.034 | +11.3 |
| 1.05 APMT | 0 | 0.108 | 194 | 2.01 | 0.35 | +.582 | * |

*Cannot be measured >30

Replacement of the PMT with MPMT and adjusting the amount of APMT in the emulsion results in improved raw stock keeping values.

This invention has been described in detail with particular reference to preferred embodiments thereof, but it will be understood that variations and modifications can be effected within the spirit and scope of the invention.

We claim:

1. A photographic recording material comprising a support, a silver halide emulsion layer and from about 1.5 mmoles to about 5.0 mmoles per mole of silver of an antifogging agent which is a combination of two compounds comprising, for each mole of 1-(3-acetamidophenyl)-5-mercaptotetrazole, from 0.3 to 4.0 mole of 1-(3-methoxyphenyl)-5-mercaptotetrazole.

2. The photographic recording material of claim 1 which comprises a dye-forming coupler compound.

3. The photographic recording material of claim 2 where the dye-forming coupler is a magenta coupler.

4. The photographic recording material of claim 3 wherein the dye-forming coupler has the following formula:

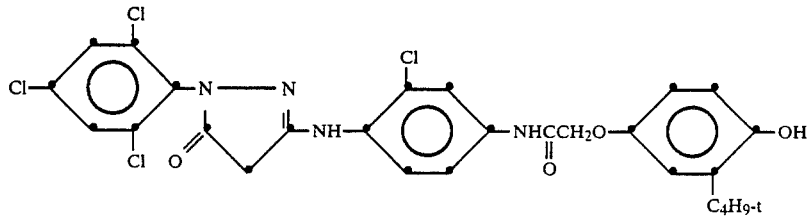

5. The photographic recording material of claim 1 wherein the antifogging agent is present in the silver halide emulsion at a concentration of from about 1.5 mmoles to about 2.5 mmoles per mole of silver.

6. The photographic recording material of claim 1 wherein the silver halide is predominantly silver chloride.

* * * * *